US005488756A

United States Patent [19]

Hsieh

[11] Patent Number: 5,488,756

[45] Date of Patent: Feb. 6, 1996

[54] HANDLE DEVICE

[76] Inventor: Dick M. Hsieh, No. 18, Lane 777, Chung-Shan Rd., Kuei-Jen Hsiang, Tainan Hsien, Taiwan

[21] Appl. No.: 270,266

[22] Filed: Jul. 5, 1994

[51] Int. Cl.[6] ..... B25G 1/021

[52] U.S. Cl. ..... 16/115; 16/111 R; 190/18 A; 190/115; 280/47.371; 280/655; 294/19.1

[58] Field of Search ..... 280/38, 638, 651, 280/654, 655, 47.315, 47.371; 190/18 R, 18 A, 39, 115; 16/111 R, 115; 294/19.1

[56] References Cited

U.S. PATENT DOCUMENTS

| | | | |
|---|---|---|---|
| 4,254,850 | 3/1981 | Knowles | 16/115 |
| 4,974,871 | 12/1990 | Mao | 280/651 |
| 5,355,980 | 10/1994 | Hsieh | 190/115 |
| 5,379,486 | 1/1995 | Wang | 16/115 |
| 5,400,472 | 3/1995 | Chang | 16/115 |
| 5,414,895 | 5/1995 | Kazmark, Jr. | 16/115 |

*Primary Examiner*—W. Donald Bray
*Attorney, Agent, or Firm*—Ladas & Parry

[57] ABSTRACT

The handle device includes a frame member and a handle member. The frame member has a pair of longitudinal grooves, while the handle member has two first tubes mounted securely in the longitudinal grooves, at least one of the first tubes being provided with a plurality of longitudinally aligned holes, and a U-shaped handle with two opposed second tubes inserted slidably in the first tubes. A spring-loaded projection member is mounted to the first end of the second tube which is enclosed by the first tube that is formed with the longitudinally aligned holes. A spring-biased actuating lever is mounted pivotally to the U-shaped handle such that a front end of the actuating lever is located nearer to the second tube than a rear end of the same. A rigid connecting stick is disposed inside the second tube and connects the spring-loaded projection member to the front end of the actuating lever. When the lever is at the normal condition, the spring-loaded projection member engages one of the holes of the first tube.

2 Claims, 7 Drawing Sheets

HANDLE DEVICE

BACKGROUND OF THE INVENTION

1. Field of the Invention

The invention relates to a handle device, more particularly to a retractable handle device for a wheeled trunkcase.

2. Description of the Related Art

Referring to FIG. 1, a conventional retractable handle device (B) is shown to comprise a frame member 12, a handle member 13 and a locking mechanism 14. As illustrated in FIG. 2, the frame member 12 is mounted on a rear surface (C) of the trunkcase (A) and includes a pair of longitudinally extending storage tubes 131, each of which having an open top end 1311 and a first hole 1312 adjacent to the top end 1311. The handle member 13 is U-shaped and has two parallel arm portions 132 inserted slidingly into the storage tubes 131 via from the top end 1311 of the latter. An engaging device (not shown), associated with the storage tubes 131 and the parallel arm portions 132, prevents disengagement among the storage tubes 131 and the parallel arm portions 132. When the parallel arm portions 132 are pulled out from the storage tubes 131 so as to be at the fully extended position. Each of the parallel arm portions 132 has a plurality of longitudinally aligned holes 134 formed therethrough. The holes 134 can selectively aligned with the first hole 1312 of the storage tubes 131 when the parallel arm portions 132 move axially within the storage tubes 131.

The locking mechanism 14 is mounted on the frame 12 between the storage tubes 131 and includes a pair of spring-loaded projection members 15 which have a projection 151 that is aligned with and that extends into the first hole 1312 of the respective storage tube 131 at normal conditions. When the arm portions 132 are moved within the storage tubes 131, thereby aligning one of the longitudinally aligned holes 134 with the first hole 1312 of the storage tube 131, the projections 151 extend into the aligned hole 134 of the arm portions 132 via the first hole 1312. Note that the spring-loaded projection members 15 can be operated manually via openings 121 formed through the frame member 12 to disengage the projections 151 from the holes 134, 1312 when desired.

It is noted that the length of the handle member 13 cannot be adjusted with the use of a single hand. When adjusting the handle member 13 so as to be at the desired length, one hand must operate the locking mechanism 14 to release the projection 151 from the holes 134, 1312, while the other hand pulls out the handle member 13 from the storage tubes 131. This is inconvenient to the user, especially when one of his hands is already carrying an article.

SUMMARY OF THE INVENTION

A main objective of the present invention is to provide a retractable handle device which can be operated by the use of a single hand so as to pull or push a handle member to any desired position and retain the same thereat.

Accordingly, the retractable handle device of the present invention includes a frame member to be mounted on a surface of a trunkcase and a handle member inserted into the frame member for pulling or pushing the wheeled trunkcase. The frame member has top and bottom end portions and a pair of longitudinal grooves extending between the top and bottom end portions. The handle member includes a pair of first tubes mounted securely in the longitudinal grooves of the frame member, at least one of the first tubes having a plurality of longitudinally aligned holes, a pair of second tubes, each having a first end inserted slidably in a respective one of the first tubes and a second end exposed exteriorly of the respective one of the first tubes, and a transverse rod which interconnects the second ends of the pair of second tubes. A spring-loaded projection member is mounted to the first end of the second tube which is enclosed by the first tube that is formed with the longitudinally aligned holes. The handle member further includes an actuating lever with front and rear ends and an intermediate portion between the front and rear ends. The intermediate portion of the actuating lever is mounted pivotally to the transverse rod such that the front end of the actuating lever is located nearer to the second tube than the rear end of the same. A rigid connecting stick is disposed longitudinally in the second tube and connects the spring-loaded projection member to the front end of the actuating lever. A biasing spring, associated with the transverse rod, biases the actuating lever such that the rear end of the actuating lever is spaced from an inner surface of the transverse rod while the front end of the actuating lever is located nearer to the inner surface of the transverse rod. Under this condition, the spring-loaded projection member engages one of the aligned holes of the first tube.

In the disclosed embodiment, the spring-loaded projection member preferably comprises a rectangular hollow seat member which has an open top fixed to the first end of the second tube, a closed bottom and a peripheral wall between the closed bottom and the open top. The peripheral wall confines a receiving space therein which is communicated with the interior of the second tube via the open top. The peripheral wall has an opening which is formed therethrough and which can be aligned selectively with the longitudinally aligned holes when the second tube is moved axially in the first tube. A pivot member is mounted pivotally in the receiving space of the rectangular seat member and which has a top face with a portion which is spaced from the pivot point and which is connected to one end of the elongated connecting stick and, a lower section which is provided with an inclined pressing face. A slide piece is disposed movably on the closed bottom of the seat member below the pivot member. The slide piece has an inclined front end face which corresponds to and which abuts the inclined pressing face of the pivot member, and a rear end face opposite to the front end face. A projection extends from the front end face and is aligned with the opening of the peripheral wall. A compression spring is disposed between the rear end face of the slide piece and the peripheral wall and urges the slide piece toward the opening of the peripheral wall of the seat member.

When the second tubes are moved axially in the first tubes to align the projection of the slide piece with one of the longitudinally aligned holes of the first tube, the projection passes through the opening of the seat member and extends into one of the longitudinally aligned holes. Thus, the handle member is engaged to the frame member.

When it is desired to release the handle member from the frame member, the user can press the rear end of the actuating lever against the biasing action thereon, thereby retracting the projection of the slide piece interiorly of the second tube to disengage the first tubes.

Since adjustment of the handle member can be done with the use of a single hand, the handle device according to the present invention is more convenient to use than the prior art.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

The mounting of the handle device of the present invention to a wheeled trunkcase or any suitable suitcase is similar to that of the prior art. Since the mounting operation employed is not directly concerned with the present invention, detailed description thereof will be omitted and only the characterizing features of the present invention will be described in the following.

Figure 1:
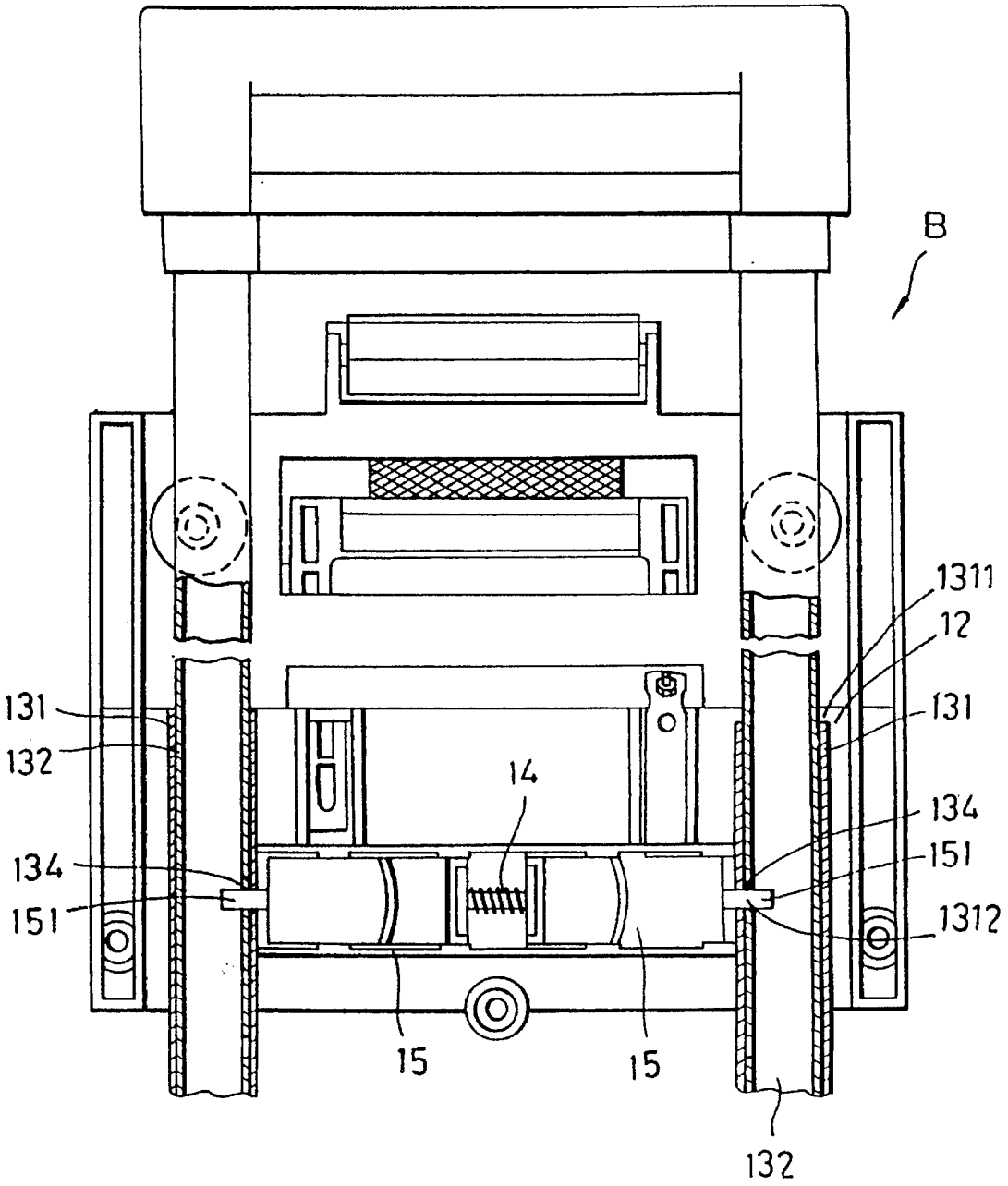
FIG. 1 (PRIOR ART)
FIG. 1 shows a conventional retractable handle device.
Figure 2:
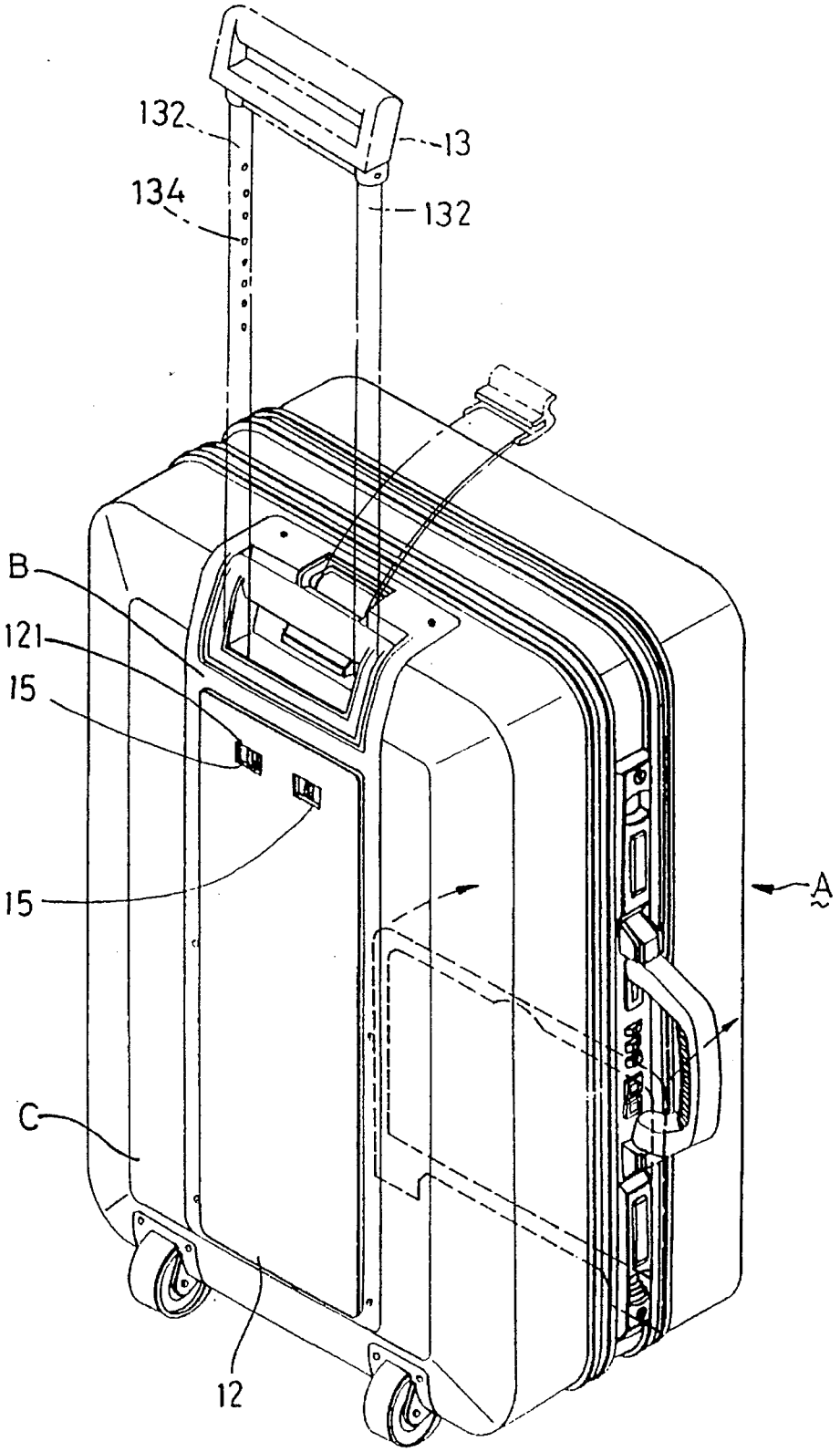
FIG. 2 (PRIOR ART)
FIG. 2 shows the conventional retractable handle device when mounted on a wheeled trunkcase.
Figure 3:
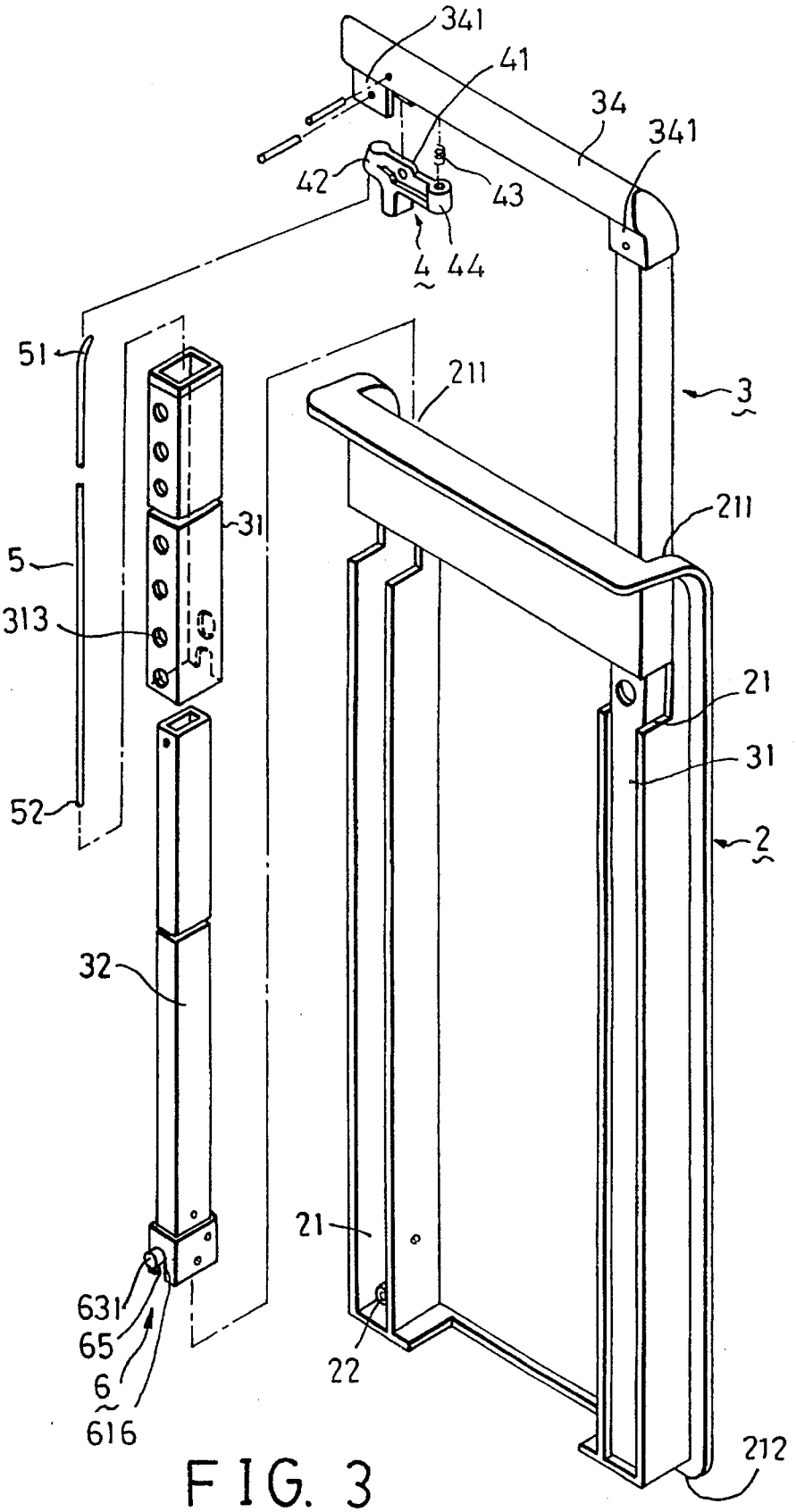
FIG. 3 shows an exploded view of a retractable handle device of the present invention.

Referring to FIG. 3, an exploded view of a retractable handle device of the present invention is shown to comprise a frame member 2 and a handle member 3.

The frame member 2 is adapted to be mounted on a rear surface of a wheeled trunkcase (not shown) and has top and bottom end portions 211, 212 and a pair of longitudinal grooves 21 which extend between the top and bottom end portions 211, 212 thereon.

The handle member 3 is U-shaped and includes a pair of first tubes 31, a pair of second tubes 32, a transverse rod 34 and an actuating lever 4. The first tubes 31 are mounted securely in the longitudinal grooves 21 of the frame member 2. The second tubes 32 has first ends inserted slidably into the first tubes 31 such the second ends of the same are exposed exteriorly of the first tubes 31. The transverse rod 34 interconnects the second ends of the second tubes 32. Each of the opposed ends of the transverse rod 34 respectively has two downwardly extending spaced ears 33.

To facilitate understanding and explanation of the present invention, only one set of first and second tubes 31, 32 will be described hereinafter. The first tube 31 has a plurality of longitudinally aligned holes 313. The first end of the second tube 32 that is enclosed by the first tube 317 has a spring-loaded projection member 6 mounted thereat.

Figure 4:
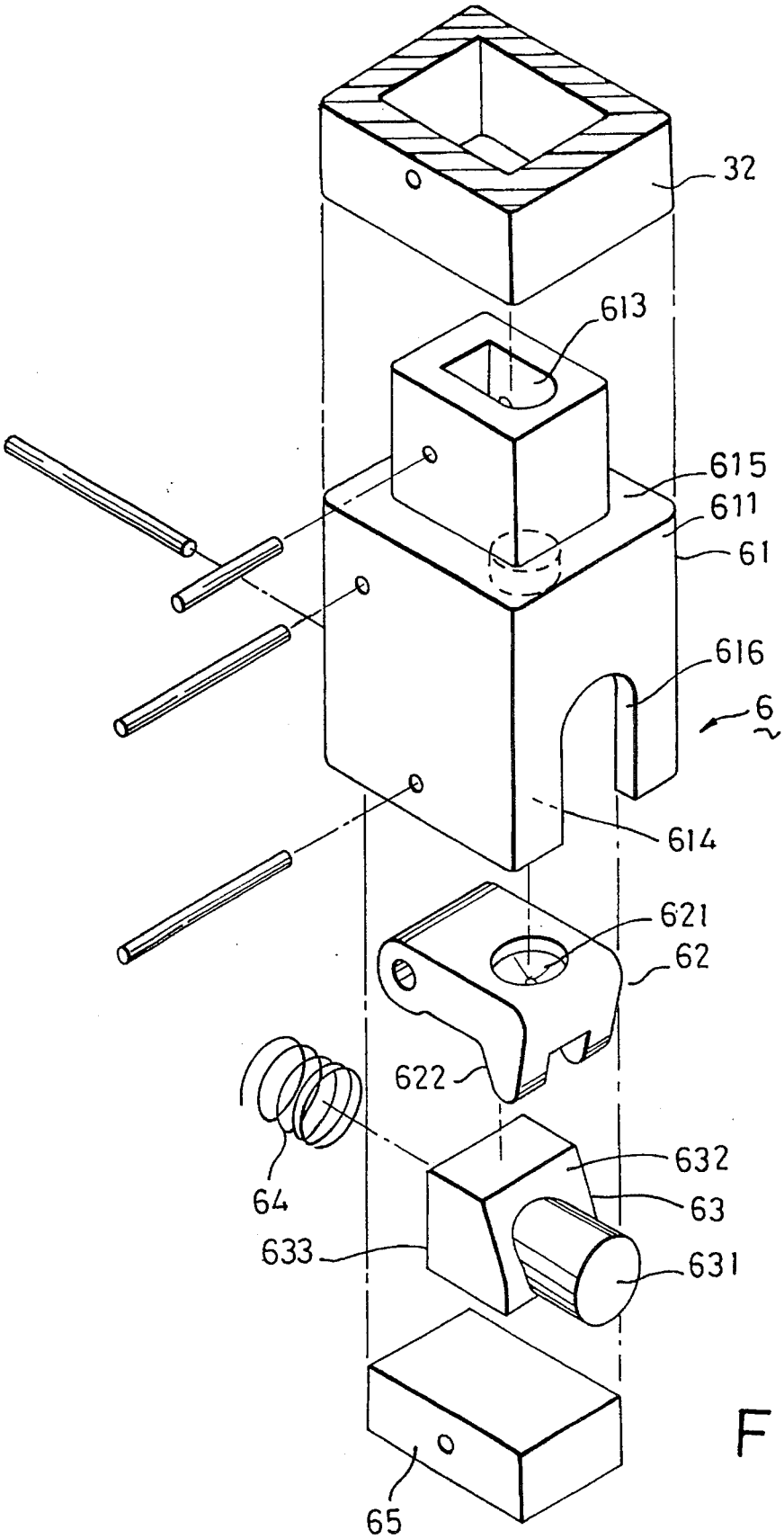
FIG. 4 shows an exploded view of a spring-loaded projection member employed in the retractable handle device of the present invention.

Referring to FIG. 4, the spring-loaded projection member 6 comprises a hollow rectangular seat member 61 which has an open top 613 fixed to the first end of the second tube 32, a bottom plate fixed to a lower end so as to form a closed bottom 65, and a peripheral wall 611 between the closed bottom 65 and the open top 613. The open top 613 of the hollow seat member 61 is rectangular in cross section and which is smaller than the main body of the seat member 61 such that a shoulder 615 is formed between the open top 613 and the main body. The first end of the second tube 32 rests on the shoulder 615. The peripheral wall 611 of the hollow seat member 61 defines a receiving space 614 therein. The receiving space 614 is communicated with the interior of the second tube 32 via the open top 613. The peripheral wall 611 has an opening 616 formed therethrough. The opening 616 can be aligned selectively with the longitudinally aligned holes 313 when the second tube 32 is moved axially within the first tube 31. A pivot member 62 is mounted pivotally in the receiving space 614 and has a top face with an engaging hole 621 which is spaced from the pivot point and a lower section which is provided with an inclined pressing face 622. A slide piece 63 is disposed movably on the closed bottom 65 below the pivot member 62. The slide piece 63 has an inclined front end face 632 which corresponds to and which abuts the inclined pressing face 622 of the pivot member 62, and a rear end face 633 opposite to the front end face 632. A projection 631 extends from the front end face 632 and is aligned with the opening 616 of the peripheral wall 611. A compression spring 64 is disposed between the rear end face 633 of the slide piece 63 and the peripheral wall 611 such that the slide piece 63 is urged toward the opening 616 of the peripheral wall 611 of the seat member 61 at normal conditions.

Figure 5:
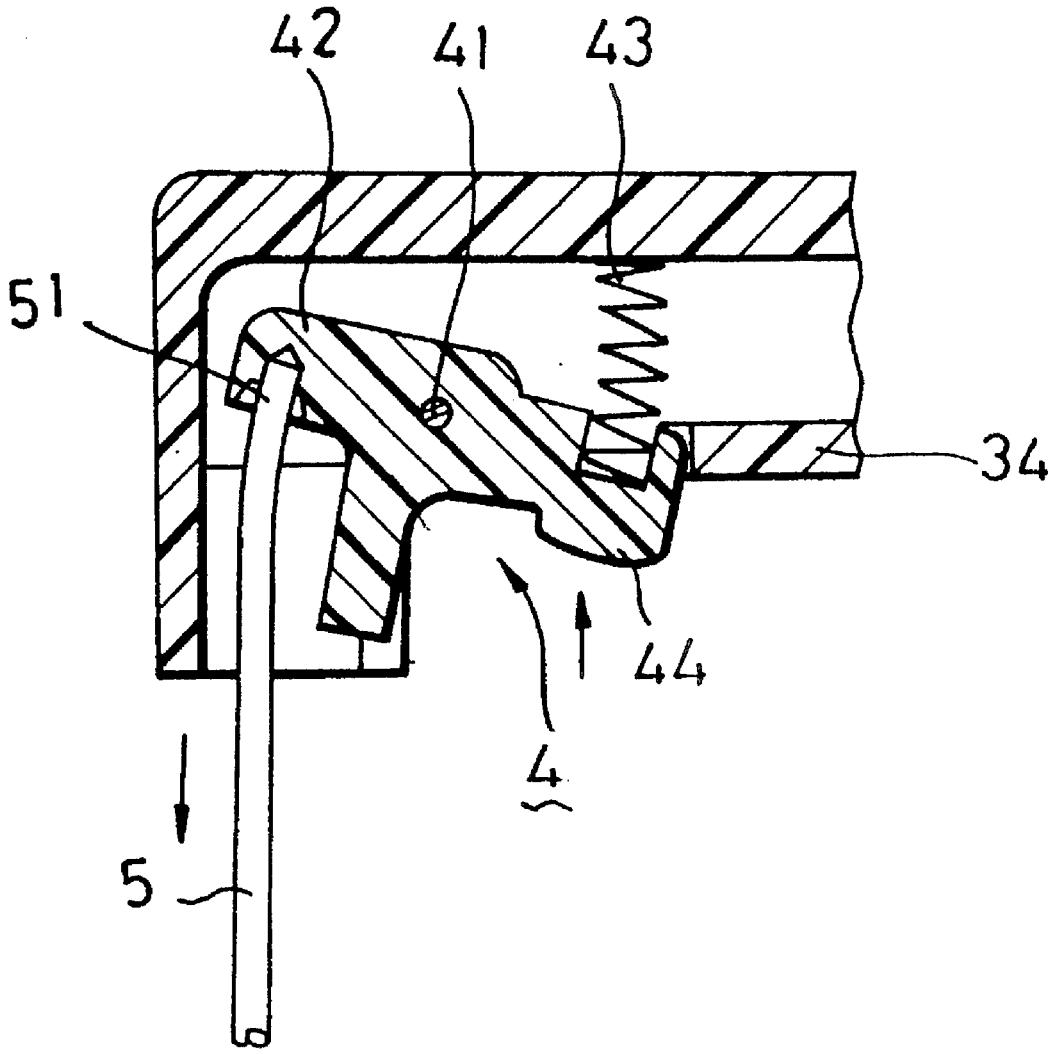
FIG. 5 illustrates a cross sectional view of an actuating lever employed in the retractable handle device of the present invention.
Figure 6:
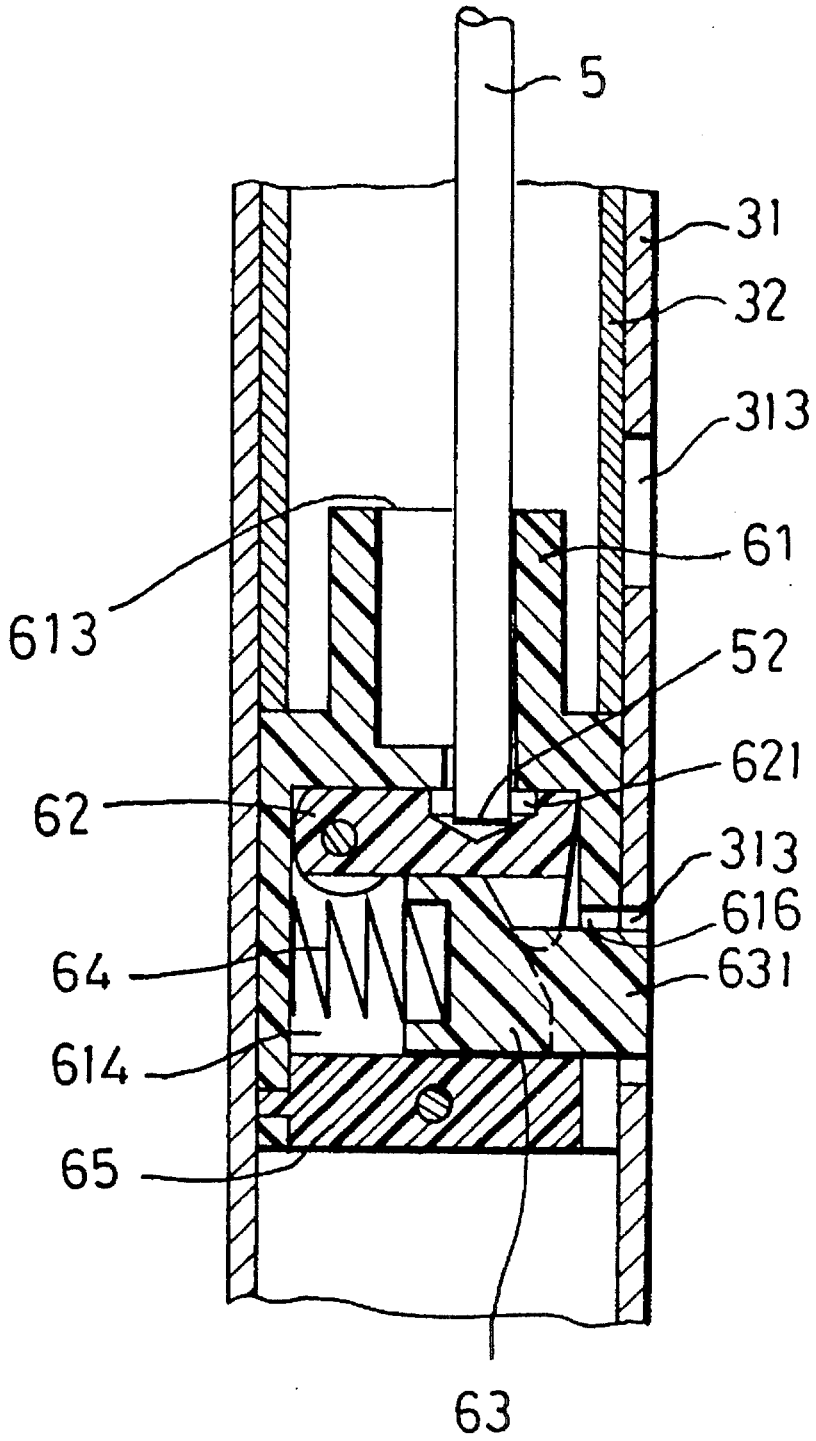
FIG. 6 shows a cross sectional view of a preferred embodiment of the present invention, the handle member being illustrated in an engaged configuration.
Figure 7:
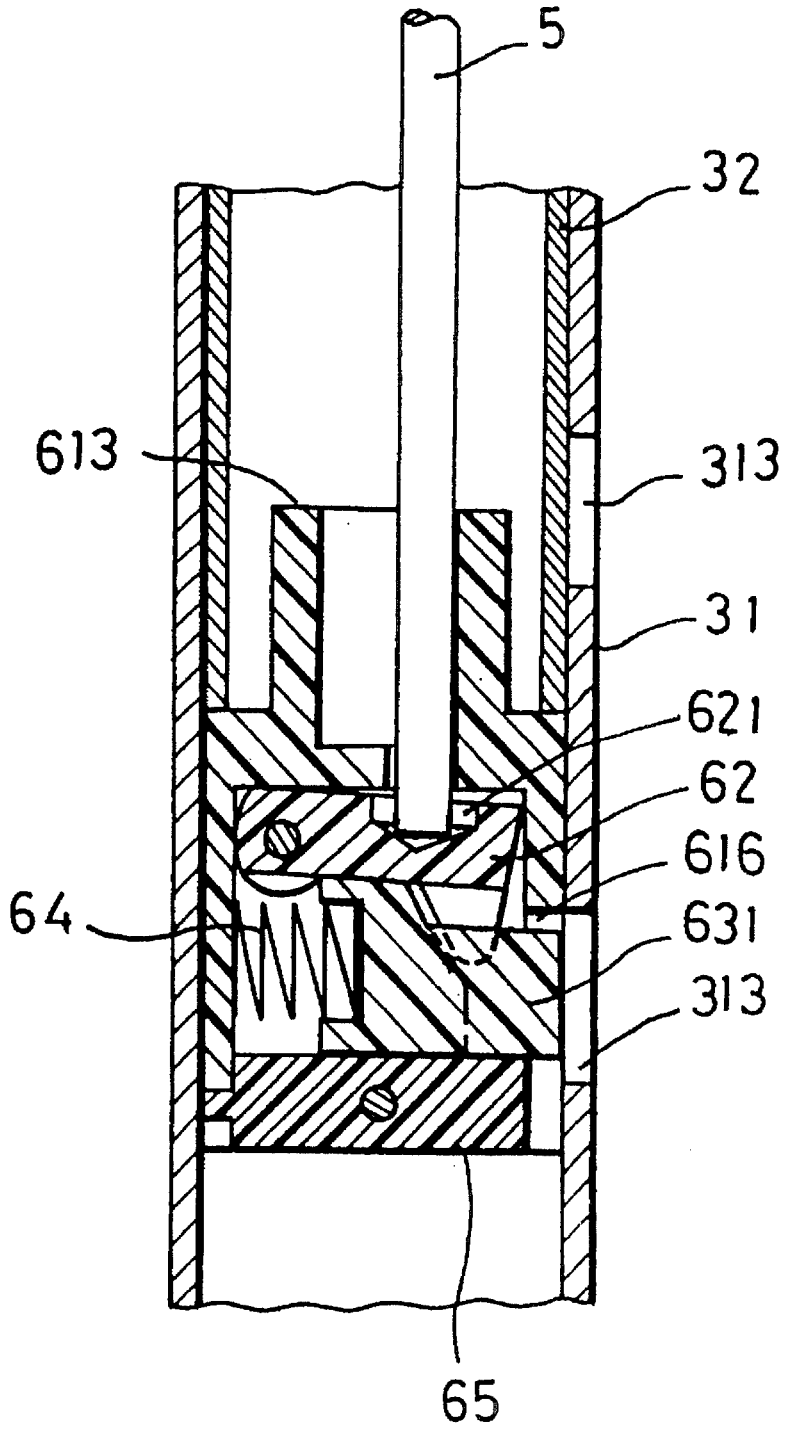
FIG. 7 shows a cross sectional view of the preferred embodiment of the present invention, the handle member being illustrated in a released configuration.

Referring to FIG. 5, the actuating lever 4 has a front and rear ends 42, 44 and an intermediate portion 41 between the front and rear ends 42, 44. The intermediate portion 41 of the actuating lever 4 is mounted pivotally to the spaced ears 341 of the transverse rod 34 such that the front end 42 of the actuating lever 4 is located nearer to the second tube 32 than the rear end 44 of the same. An elongated rigid and non-extendible connecting stick 5 is disposed longitudinally in the second tube 32 and has an upper end 51 which is connected securely to the front end 42 of the actuating lever 4, and a lower end 52 which extends through the open top 613 of the seat member 61 and which engages the engaging hole 621 of the pivot member 62. A biasing spring 43, such as a compression spring, is attached to the transverse rod 34 and biases the rear end 44 of the actuating lever 4 such that the rear end 44 of the actuating lever 4 is spaced from an inner surface of the transverse rod 34, while the front end 42 of the actuating lever 4 pivots so as to locate nearer to the inner surface of the transverse rod 34. Under such a condition, the pivot member 62 is slightly lifted upward due to movement of the front end 42 of the actuating lever 4. The slide piece 63 is pushed toward the opening 616 of the peripheral wall 611 of the seat member 61. When the second tube 32 is moved axially in the first tube 31 to align the projection 631 of the slide piece 63 with one of the aligned holes 313, the projection 631 passes through the opening 616 of the seat member 61 and extends into the aligned hole 314. Thus, the second tube 32 engages the first tube 31, as shown in FIG. 6.

When it is desired to release the second tube 32 from the first tube 31, the rear end 44 of the actuating lever 4 is pressed to compress the pivot member 62. The pivot member 62 pivots downwardly such that the slide piece 63 is depressed against biasing action of the compression spring 64. The projection 631 of the slide piece 63 is retracted consequently from the hole 313 of the first tube 31 and moves interiorly of the second tube 32. Thus, the second tube 32 is released from the first tube 31 and can be moved relative to the latter.

Since adjustment of the handle member 3 can be done with the use of a single handle, the handle device of the present invention is more convenient to than the prior art. The feature and objective of the present invention are thus achieved.

While a preferred embodiment has been described and explained, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. A handle device comprising:

a frame member to be mounted on a surface of a trunkcase and having top and bottom end portions and a pair of longitudinal grooves extending between said top and bottom end portions thereof;

a handle member including a pair of first tubes mounted securely in said longitudinal grooves of said frame member, at least one of said first tubes having a plurality of longitudinally aligned holes, a pair of second tubes, each having a first end inserted slidably in a respective one of said first tubes and a second end exposed exteriorly of said respective one of said first tubes, a transverse rod interconnecting said second ends of said pair of second tubes, a spring-loaded projection member mounted to said first end of said second tube which is enclosed by said first tube with said longitudinally aligned holes, said handle member further including an actuating lever with front and rear ends and an intermediate portion between said front and rear ends, said intermediate portion of said actuating lever being mounted pivotally to said transverse rod such that said front end of said actuating lever is located nearer to said second tube than said rear end of said actuating lever, an elongated connecting stick disposed longitudinally in said second tube and connecting said spring-loaded projection member to said front end of said actuating lever, and a biasing spring associated with said transverse rod, said biasing spring biasing said actuating lever such that said rear end of said actuating lever is spaced from an inner surface of said transverse rod while said front end of said actuating lever is located nearer to said inner surface of said transverse rod, thereby enabling said spring-loaded projection member to engage one of said aligned holes of said first tube when said spring-loaded projection member is aligned with said one of said aligned hole due to movement of said second tubes relative to said first tubes.

2. The handle device as defined in claim 1, wherein said first tubes are rectangular in cross section and said spring-loaded projection member comprises: a rectangular hollow seat member corresponding to and slidably received by a respective one of said first tube, said seat member having an open top fixed to said first end of said second tube, a closed bottom and a peripheral wall between said closed bottom and said open top, said peripheral wall confining a receiving space therein, said receiving space being communicated with an interior of said second tube via said open top, said peripheral wall having an opening formed therethrough, said opening being aligned selectively with said longitudinally aligned holes when said second tubes are moved axially within said first tubes; a pivot member mounted pivotally in said receiving space and having a top face with a portion which is spaced from said pivot point and which is connected to one end of said elongated connecting stick, and a lower section which is provided with an inclined pressing face; a slide piece disposed movably on said closed bottom below said pivot member, said slide piece and having an inclined front end face which corresponds to and which abuts said inclined pressing face of said pivot member and a rear end face opposite to said front end face, said front end face having a projection extending therefrom and being aligned with said opening of said peripheral wall; and a compression spring disposed between said second end portion of said rear end face of said slide piece and said peripheral wall, said compression spring urging said slide piece toward said opening of said peripheral wall of said seat member;

whereby, when said second tubes are moved axially within said first tubes to align said projection of said slide piece with one of said aligned holes, said projection passes through said opening of said seat member and extends into said one of said aligned holes.

* * * * *